US006050092A

United States Patent [19]

Genstler et al.

[11] Patent Number: 6,050,092

[45] Date of Patent: Apr. 18, 2000

[54] STIRLING CYCLE GENERATOR CONTROL SYSTEM AND METHOD FOR REGULATING DISPLACEMENT AMPLITUDE OF MOVING MEMBERS

[75] Inventors: Curtis Genstler, Everett; Ian Williford, Richland; Howard H. Bobry, Edmonds, all of Wash.

[73] Assignee: Stirling Technology Company, Kennewick, Wash.

[21] Appl. No.: 09/143,026

[22] Filed: Aug. 28, 1998

[51] Int. Cl.[7] ..... F01B 29/10

[52] U.S. Cl. ..... 60/520; 60/523; 60/526

[58] Field of Search ..... 60/517, 523, 526, 60/520

[56] References Cited

U.S. PATENT DOCUMENTS

| | | | |
|---|---|---|---|
| 3,911,284 | 10/1975 | Skala | 60/523 X |
| 4,433,279 | 2/1984 | Bhate | 322/3 |
| 4,498,295 | 2/1985 | Knoos | 60/526 X |
| 4,642,547 | 2/1987 | Redlich | 322/3 |
| 5,228,293 | 7/1993 | Vitale | 60/517 X |
| 5,743,091 | 4/1998 | Penswick et al. | 60/517 |

*Primary Examiner*—Hoang Nguyen
*Attorney, Agent, or Firm*—Wells, St. John, Roberts, Gregory & Matkin, P.S.

[57] ABSTRACT

A Stirling cycle machine control system includes an energy converter having a moving member. A detector is operatively associated with the moving member. The detector is configured to detect stroke of the moving member. A converter circuit is coupled with an output of the energy converter and is operative to convert output from AC to DC. A regulator is coupled with the converter circuit and a useful load, and is operative to regulate DC voltage. A controllably variable load member is coupled to the converter circuit and is operative to adjust load to the energy converter. Adjustment of the load to the energy converter regulates power output of the energy converter which in turn controls movement of the moving member. Control circuitry is signal coupled with the detector and the load member. The control circuitry is configured to receive a feedback signal correlated with the detected stroke of the moving member. The control circuitry is operative to dynamically adjust load on the energy converter to limit stroke of the moving member below a threshold level. A method is also provided.

25 Claims, 9 Drawing Sheets

STIRLING CYCLE GENERATOR CONTROL SYSTEM AND METHOD FOR REGULATING DISPLACEMENT AMPLITUDE OF MOVING MEMBERS

TECHNICAL FIELD

This invention relates to power conversion machinery, such as a Stirling cycle engine and alternator, and more particularly to a control system and method for controlling displacement amplitude of moving members such as pistons within a Stirling cycle generator.

BACKGROUND OF THE INVENTION

Free-piston Stirling machines have had control systems for ensuring useful power is generated by the machine while concurrently preventing overstroke of moving members that could lead to damage. One such control system uses valves or ports that detune the machine to change spring forces and/or generate damping. Such control systems are provided within the machine and can disrupt or unbalance the Stirling thermodynamic cycle which leads to inefficiencies. Such control systems are implemented internally. However, valves or ports on pistons or moving members tend to leak over time, tend to plug up from debris, and can fail over time. Furthermore, gas springs generally have high hysterisis loses. Additionally, valves do not generally perform well when subjected to abnormal or sudden load changes (i.e. transient loading conditions).

U.S. Pat. No. 4,642,547 to Redlich discloses one external electronic control system for preventing overstroke of moving members on a Stirling machine. Redlich teaches a control system that provides a fixed voltage at discrete power levels. However, such control system is inefficient, uses more components, and is more costly and complex.

SUMMARY OF THE INVENTION

Pursuant to this invention, moving members within a free-piston Stirling cycle generator are controlled such that displacement amplitude remains within a threshold value. More particularly, such displacement amplitude is controlled within an acceptable range. Accordingly, a control system is used to regulate the maximum displacement amplitude achieved by a power piston within a Stirling cycle generator in order to prevent overstroke (a maximum threshold value), as well as to prevent engine stalling (a minimum threshold value).

According to one aspect of the invention, a Stirling cycle machine control system includes an energy converter having a moving member. A detector is operatively associated with the moving member. The detector is configured to detect stroke of the moving member. A converter circuit is coupled with an output of the energy converter and is operative to convert output from AC to DC. A regulator is coupled with the converter circuit and a useful load, and is operative to regulate DC voltage. A controllably variable load member is coupled to the converter circuit and is operative to adjust load to the energy converter. Adjustment of the load to the energy converter regulates power output of the energy converter which in turn controls movement of the moving member. Control circuitry is signal coupled with the detector and the load member. The control circuitry is configured to receive a feedback signal correlated with the detected stroke of the moving member. The control circuitry is operative to dynamically adjust load on the energy converter to limit stroke of the moving member below a threshold level.

According to another aspect of the invention, a free-piston Stirling cycle generator control system is disclosed. The control system includes a generator having a linear alternator and a power piston. The generator is operative to receive energy from a source and generate an AC output. An output voltage detector is operatively associated with the power piston. The output voltage detector is configured to detect a threshold voltage value corresponding to maximum acceptable stroke of the power piston. A converter is coupled with an output of the linear alternator. The converter is operative to convert the AC output to a DC output. A regulator is coupled with the converter and a useful load. The regulator is operative to regulate DC voltage. A load member is coupled to the converter, and is operative to adjust load on the linear alternator such that power output is regulated from the linear alternator. Such regulated output in turn controls movement of the moving member. Control circuitry is coupled with the detector and the load member. The control circuitry is configured to receive a feedback signal indicative of stroke of the moving member. The control circuitry is operative to adjust load on the linear alternator so as to limit stroke of the moving member within a threshold value.

This invention also includes a method for controlling a power piston within a free-piston Stirling cycle generator, comprising driving the generator by an external energy source so as to impart movement of a power piston of a linear alternator to generate AC output; converting the AC output to a DC output; detecting movement of the power piston by monitoring the DC output; and applying a load to the linear alternator so as to adjust load on the linear alternator so as to limit movement of the power piston within a threshold value.

Objects, features and advantages of this invention are to provide a control system for a free-piston Stirling cycle generator that limits movement of the moving member, or piston, within a threshold value, is relatively easy to implement, and is reliable, durable and economical.

BRIEF DESCRIPTION OF THE DRAWINGS

Preferred embodiments of the invention are described below with reference to the following accompanying drawings.

FIG. 4 is a simplified schematic circuit diagram for the 18 Volt and reference voltage signals circuit of the moving member control system;

FIG. 7 is a simplified schematic block and circuit diagram for a multiple engine generator system using a single common controller;

FIG. 9 is a simplified oscilloscope output depicting AC ripple on a full-wave rectified DC output voltage, and switching of the bank of load resistors in response to such ripple.

DETAILED DESCRIPTION

This disclosure of the invention is submitted in furtherance of the constitutional purposes of the U.S. Patent Laws "to promote the progress of science and useful arts" (Article 1, Section 8).

The basic elements of the invention are described with reference to conventional components of an integral, free-piston Stirling Cycle generator. The features disclosed in this invention can also be applied to other non-rotating linear reciprocating members used within power conversion machinery as energy converters, such as any configuration of Stirling engines having a linear alternator and forming a generator, and other thermodynamic cycle devices which require linear reciprocation of a displacer and/or piston.

Figure 1:
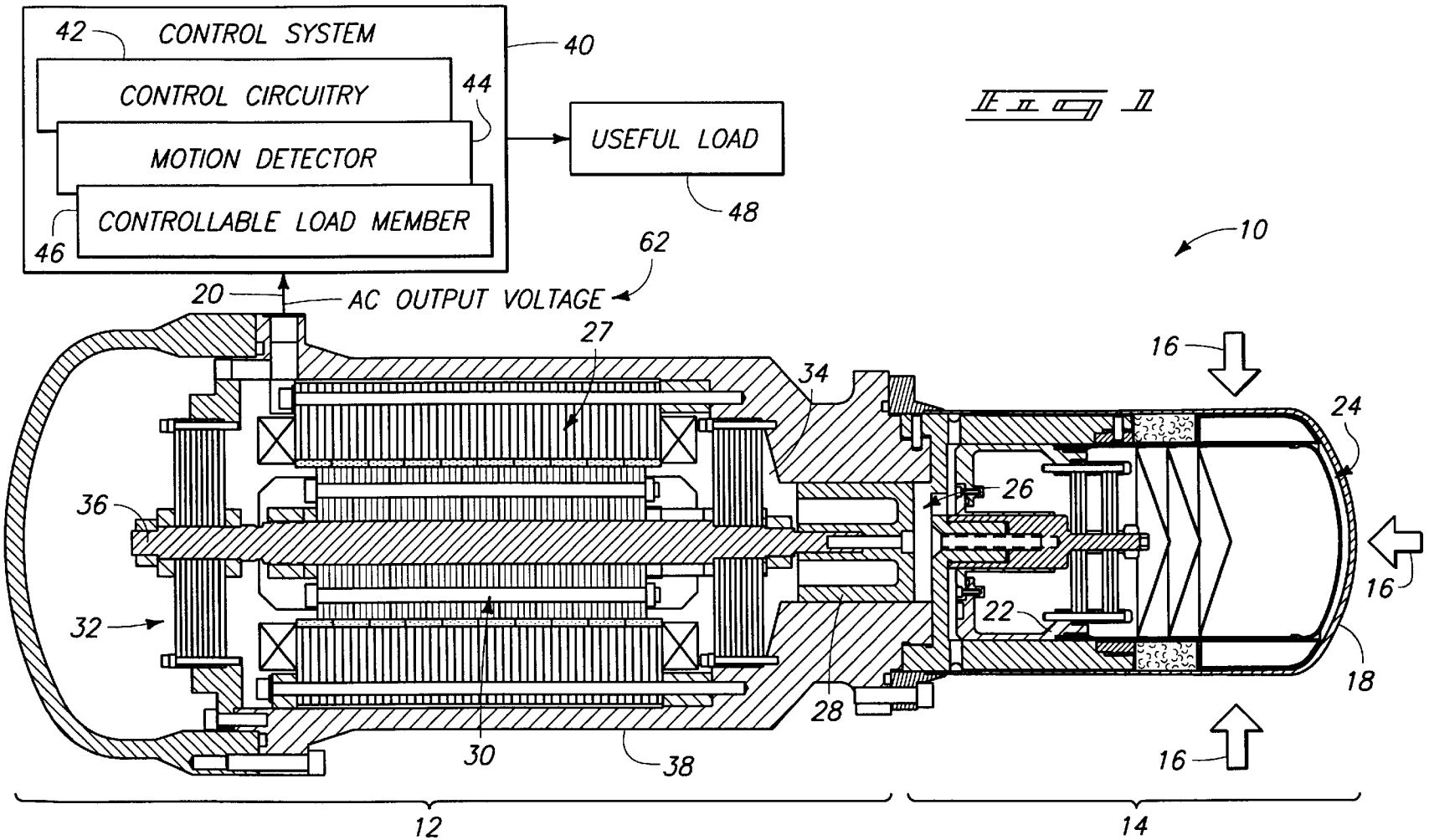
FIG. 1 is a vertical sectional view of a Stirling Cycle engine having a piston overstroke control system embodying this invention.

FIG. 1 schematically illustrates a construction for a Stirling Cycle machine in the form of a power generator 10 having a controller system of this invention. Generator 10 is formed by assembling together a power module in the form of a linear alternator 12 and an engine module in the form of a displacer assembly 14. Generator 10 is a thermal regenerative machine configured in operation to house a gaseous working fluid. Power module 12 and engine module 14 are joined together with a plurality of circumferentially spaced apart threaded fasteners. The inside of power generator 10 is filled with a charge of pressurized thermodynamic working fluid such as Helium. Alternatively, hydrogen or any or a number of suitable thermodynamically optimal working fluids can be used to fill and charge generator 10.

In use, a heat source 16 applies heat to a heater head 18 of the engine module 14, causing power module 12 to generate a supply of electric power via a power output line 20. A displacer assembly 22, comprising a movable displacer piston, forms a displacer that reciprocates between a hot space 24 and a cold space 26 in response to thermodynamic heating of the hot space from heater head 18 via heat source 16. In operation, displacer assembly 22 moves working gas between the hot and cold spaces 24 and 26. A power piston 28, suspended to freely reciprocate within power module 12 and in direct fluid communication with cold space 26, moves in response to pressure pulse variations within the cold space caused by reciprocation of displacer 22.

As shown in FIG. 1, a linear alternator is formed by power module 12 including a stator 27 and a mover 30. Stator 27 comprises an array of stationary iron laminations that are secured via a plurality of fasteners within housing 38. The stationary laminations form a plurality of spaced apart radially extending stationary outer stator lamination sets defining a plurality of stator poles, winding slots, and magnetic receiving slots. An array of annular shaped magnets are bonded to the inner diameter of the stationary laminations for the purpose of producing magnetic flux. Each magnet is received and mounted within the plurality of magnetic receiving slots. Similarly, mover 30 comprises an array of moving iron laminations that are secured to a shaft 36. Shaft 36 and such laminations move in reciprocating motion along with power piston 28. Relative motion between the moving laminations of mover 30 and the stationary laminations of stator 27 produces electrical power that is output through a power feed, or power output line, 20. Such power feed comprises an AC output voltage generated by linear alternator 12.

Construction details of one suitable 350-watt generator 10 are disclosed in Applicant's U.S. Pat. No. 5,743,091, entitled "Heater Head and Regenerator Assemblies for Thermal Regenerative Machines", herein incorporated by reference. It is understood that Applicant's control system can be implemented with any free-piston Stirling machine, generator, heat energy source, and alternator design, as described with reference to the above patent, or as is known to be of a conventional type previously known in the art.

Shaft 36 and power piston 28 are moved in axial reciprocation by pressure pulses imparted within cold space 26. Such pressure pulses are generated in response to reciprocation of displacer 22 caused by an input of heat source 16 at hot space 24. More particularly, shaft 36 and power piston 28 are carried for accurate axial reciprocation by a pair of flexure bearing assemblies 32 and 34, each formed from a plurality of flat spiral springs as known in the art and taught in the above-described Applicant's U.S. Pat. No. 5,743,091.

As shown in FIG. 1, a control system 40 is provided for controlling the amplitude of moving members within Stirling cycle generator 10 according to this invention. More particularly, control system 40 is used to regulate the maximum displacement amplitude achieved by power piston 28 and shaft 36 within housing 38 to prevent overstroke therein, to regulate the minimum displacement amplitude, and to prevent stalling.

In order to control displacement amplitude of moving members within generator 10, control system 40 receives and conditions an AC output voltage 62 (see FIG. 2) via power feed 20 of linear alternator 12. More particularly, AC output voltage 62 is produced by generator 10 and rectified in order to establish a DC voltage. Furthermore, AC output voltage 62 supplies power for control system 40, and more particularly for control circuitry 42. Such DC output voltage is then compared to a reference voltage by way of control circuitry 42. Control circuitry 42 includes a Zener diode and a voltage divider network, as discussed below with reference to FIGS. 3–8.

In operation, as the linear reciprocating displacement amplitude of power piston 28 increases, AC output voltage 62 increases, which causes current to increase commensurately. As the current increases in control circuitry 42 (see FIG. 2), and more particularly within a voltage divider of control circuitry 42, such current increases the voltage drop across individual resistors ($R_2$, $R_3$, $R_4$, $R_5$, $R8$ and $R_{52}$) present within control circuitry 42. As the voltage across such resistors exceeds a reference voltage, field effect transistors (FETs) 92, each associated with one load resistor ($R_1$, $R_{41}$, $R_{42}$, $R_{43}$, $R_{44}$ and $R_{45}$) are energized. Energizing of such FETs 92 and load resistors causes a loading down of the Stirling generator 10, which reduces displacement of power piston 28 and prevents overstroke. Hence, the displacement amplitude of the power piston 28 is held below a threshold maximum value.

Control system 40 is operative to control displacement amplitude of power piston 28 within housing 38 such that overstroking does not occur. A threshold level is pre-set by adjusting a Zener diode ($Z_1$) 88 (see FIG. 3) to configure control system 40, wherein contact might otherwise occur between power piston 28 and an end portion of displacer assembly 14. It has long been understood that free-piston Stirling engines having integrated linear alternators for power generation, such as generator 10, have proven difficult to control. Such difficulties usually occur where transient loading conditions are encountered such as during generator startup, shutdown, and during load changes, or with a mismatched load condition. As a consequence, piston overstroke most commonly occurs, which can result in damage to internal engine components.

Because piston stroke is directly proportional to AC output voltage 62, Applicant's present invention imposes a specific voltage limit via a voltage limiter in order to limit stroke of power piston 28. More particularly, a specific DC voltage limit is imposed by using a parasitic load in the form of a controllably adjusted load member.

Applicant has found that attempts to manually control resistive loading for generator 10 proved difficult to achieve without encountering severe overstroking conditions for power piston 28. Applicant's invention automatically controls such process via control system 40 so as to provide instantaneous safety protection during operation thereof.

Figure 2:
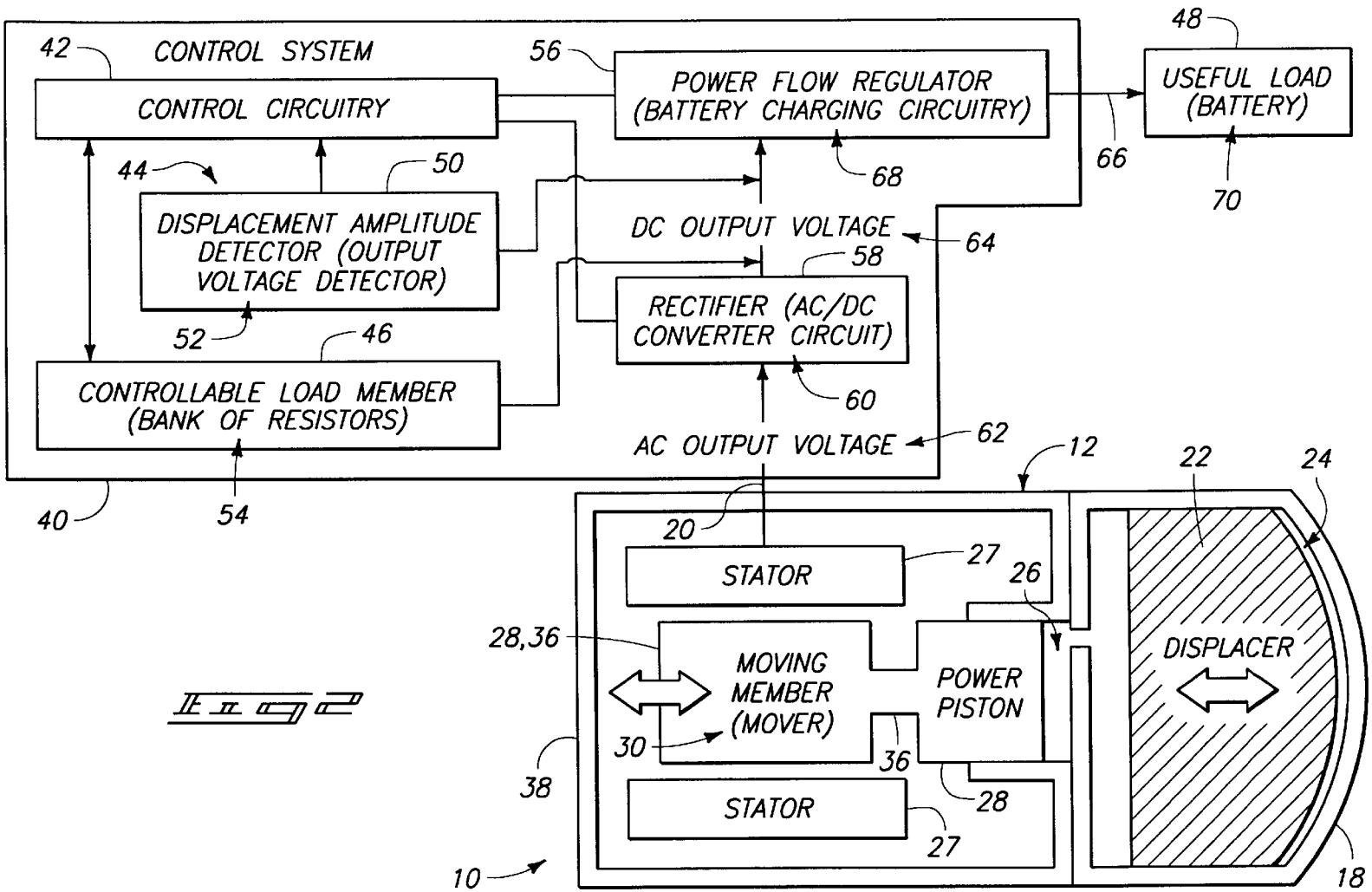
FIG. 2 is a simplified schematic and block diagram for the moving member stroke control system of FIG. 1.

As shown in FIG. 1, control system 40 includes control circuitry 42, a motion detector 44, and a controllable load member 46. Control system 40 conditions AC output voltage 62 so as to deliver an output to a useful load 48. Optionally, controllable load member 46 forms the sole load placed upon linear alternator 12. According to one implementation as shown in FIG. 2, power flow regulator 56 comprises battery charging circuitry 68. According to another implementation, useful load 48 comprises a battery 70.

Control circuitry 42 is signal coupled with motion detector 44 and controllable load member 46, and is configured to receive a feedback signal that is correlated with the detected stroke of the moving member or power piston 28. Control circuitry 42 is operative to dynamically adjust load on generator or energy converter 10 in order to maintain stroke of power piston 28 within a desired range.

As disclosed in FIG. 1, Stirling free-piston generator 10 comprises an energy converter having a moving member. More particularly, such moving member includes power piston 28 and shaft 36. It is understood that any other form of energy converter and/or generator can be used in implementing Applicant's invention. Accordingly, control system 40 comprises a Stirling cycle machine control system operative to control displacement amplitude of moving members therein.

Motion detector 44 of control system 40 is operatively associated with the moving member, such as power piston 28, and is configured to detect stroke of such moving member. More particularly, motion detector 44 comprises an output voltage detector 52 (see FIG. 2) that monitors output voltage from linear alternator 12 in order to determine displacement amplitude of power piston 28. For example, displacement amplitude of power piston 28 has been found to be linearly proportional with output voltage received from power feed 20. Accordingly, control circuitry can be adjusted to correlate output voltage with displacement amplitude. By measuring the allowable maximum stroke provided for power piston 28 within generator 10, a threshold output voltage can be determined beyond which an overstroke condition will be detected. Hence, motion detector 44 can be pre-set by adjusting control circuitry so as to detect the occurrence of such threshold voltage condition indicative of overstroke of power piston 28.

Optionally, motion detector 44 can be formed from any of a number of sensors capable of detecting the positioning of moving members such as power piston 28 and shaft 36 within housing 38. For example, any of a number of sensors, including Hall effect sensors, optical sensors, or any other form of suitable detection device, can be utilized in detecting such overstroke condition.

As shown in FIG. 1, controllable load member 46 is coupled with generator 10 to form a parasitic load. Controllable load member 46 is operative to adjust load to generator 10 so as to regulate output from linear alternator 12 which in turn controls movement of the moving member, or power piston 28.

As shown in FIG. 2, control system 40 is illustrated in use with a linear alternator 12 of a free-piston Stirling generator 10 (as shown in FIG. 1). Control system 40 is illustrated in greater detail, with motion detector 44 being depicted as a displacement amplitude detector 50. More specifically, displacement amplitude detector 50 comprises an upward voltage detector 52 according to one implementation. Controllable load member 46 is also illustrated in one embodiment as a bank of resistors 54. Control system 40 also includes control circuitry 42 which is operatively associated with detector 50 and load member 46. Additionally, a power flow regulator 56 and a rectifier 58 are provided by control system 40. According to one implementation, power flow regulator 56 comprises battery charging circuitry 68. Also according to one implementation, rectifier 58 comprises an AC/DC converter circuit 60.

Control system 40 receives an AC output voltage 62 by way of power feed 20. Such voltage is converted to a DC output voltage 64 by rectifier 58, after which power flow regulator 56 delivers a regulated power output 66 to a useful load 48. DC output voltage 64 is thereby regulated within a range of threshold values. According to one implementation, useful load 48 comprises a battery 70.

FIG. 2 illustrates controllable load member 46 in one form as a bank of resistors 54. Such bank of resistors 54 is coupled to generator 10 via AC output voltage 62 to operatively adjust load to generator 10. Such operative adjustment regulates output of alternator 12 which in turn controls movement of power piston 28. Control circuitry 42 is signal coupled with detector 50 and load member 46, and is configured to receive a feedback signal correlated with the detected stroke of power piston 28. Control circuitry 42 is operative to dynamically adjust a parasitic load on generator 10 to maintain stroke of power piston 28 within a desired range. Additionally, regulator 56 is coupled with converter circuit 60, and is operative to regulate DC voltage and control power flow to useful load 48. Converter circuit 60 is coupled with an output comprising AC output voltage 62 and is operative to convert such output from AC to DC.

According to one implementation depicted in FIG. 2, where power flow regulator 56 comprises battery charging circuitry 68 and useful load 48 comprises battery 70, a battery charger is provided having overstroke protection and stall control. The overstroke protection comprises bank of resistors 54. The stall control prevents generator 10 from stalling due to an overload condition being placed on generator 10 by useful load 48 and/or battery 70. More particularly, battery charging circuitry 68 comprises a plurality of DC to DC voltage regulators (see FIG. 6) that are controlled via control circuitry 42 based on the regulated output of Stirling free-piston generator 10. Power is delivered to battery 70 through such voltage regulators (comprising battery charging circuitry 68) at a power level that does not pull down the displacement of power piston 28 to an amplitude that is below a predetermined limit. As battery 70 becomes fully charged, excess power is diverted to amplitude control circuitry comprising control circuitry 42 and bank of resistors 54.

Accordingly, FIG. 2 illustrates overstroke and stall protection circuitry that are implemented via control system 40 and control circuitry 42. Stall condition protection is provided by battery charging circuitry 68 and battery 70 in combination with control circuitry 42. Additionally, overstroke protection is provided via control circuitry 42, bank of resistors 54, rectifier 58 and power flow regulator 56. Hence, a free-piston amplitude controller for a free-piston Stirling generator 10 using a linear alternator 12 provides for desired control when generating power.

Figure 3:
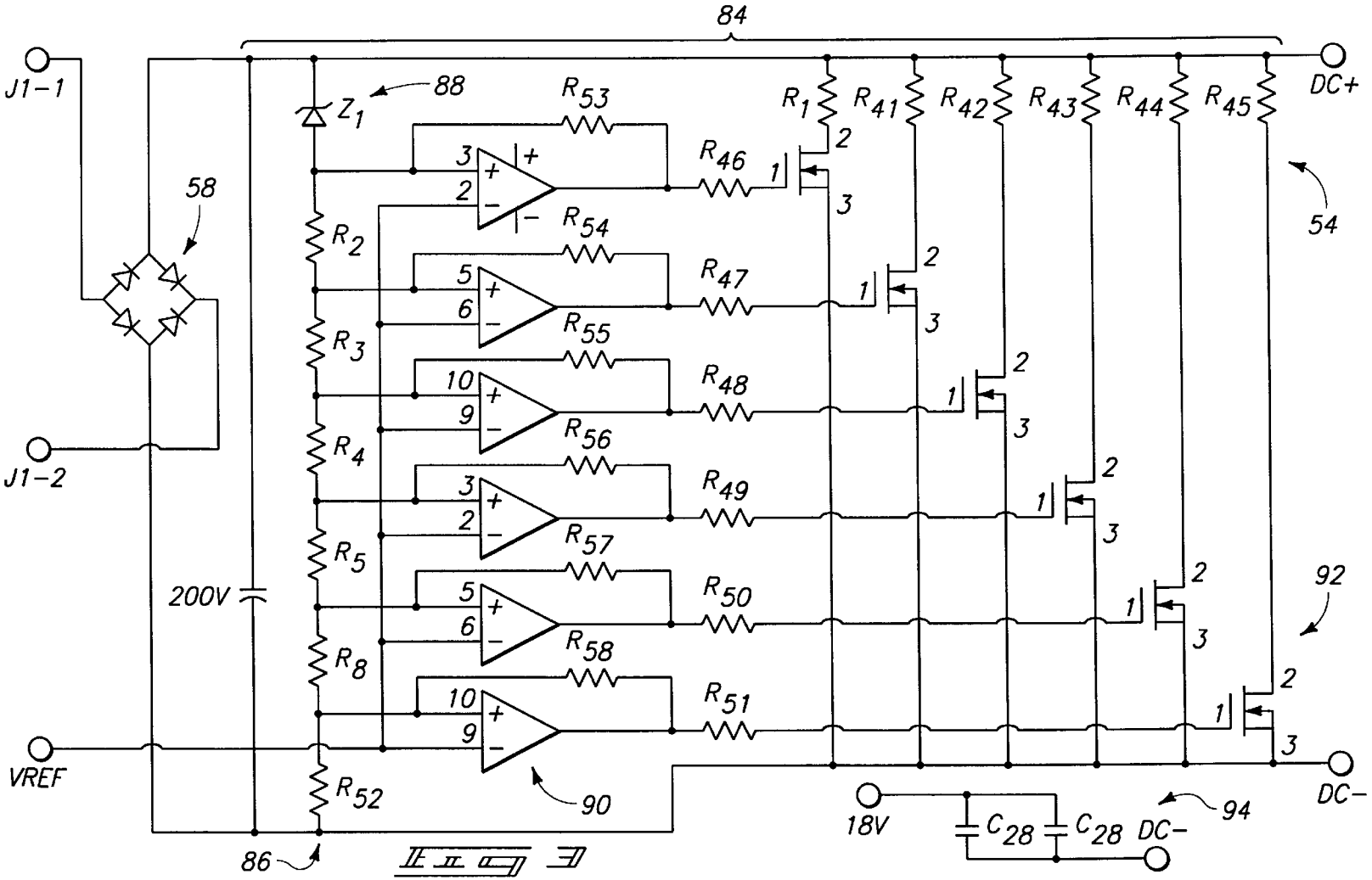
FIG. 3 is a simplified schematic circuit diagram for the rectifier and voltage regulating circuit of the moving member control system.
Figure 11:
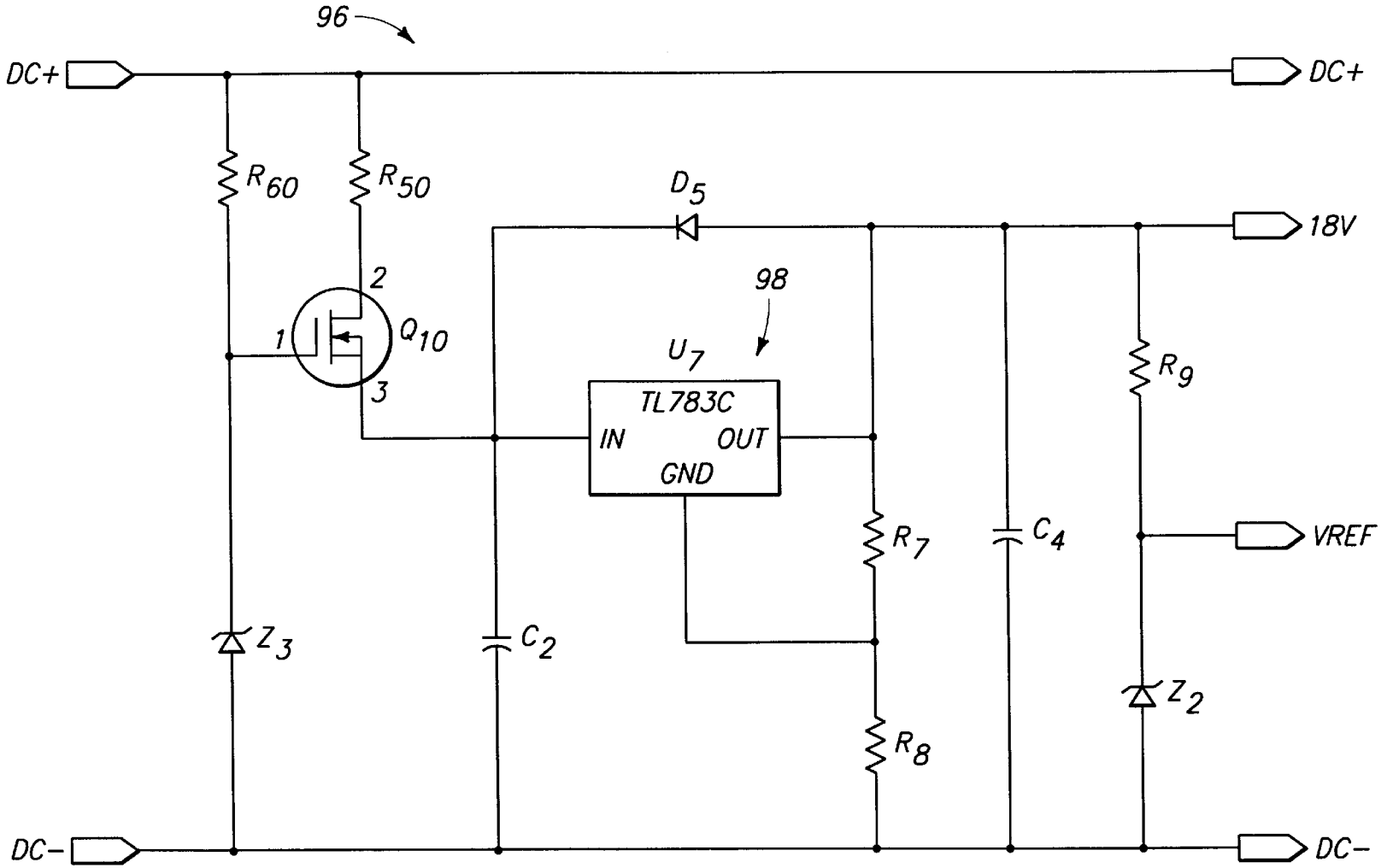

FIG. 3 illustrates a simplified schematic circuit diagram for a rectifier and voltage regulating circuit of control system 40 (of FIG. 2). Such circuitry comprises rectifier 58 and overstroke protection circuitry 84. Overstroke protection circuitry 84 is engaged whenever an overstroke condition is detected by amplitude detector 50 (of FIG. 2). Accordingly, such circuitry provides voltage regulation and comprises voltage regulating circuitry. For example, when a battery 70 is provided as useful load 48 (see FIG. 2), the batteries might approach a full charge state which could lead to an overstroke condition. Similarly, if a useful load, such as a battery, is suddenly disconnected which generates a transient load condition such that the load is quickly diminished, an overstroke condition could occur to the power piston. Rectifier 58 and overstroke protection circuitry 84 are operative so as to generate a controllable load that prevents such overstroke condition. Such circuitry is utilized whenever an overstroke condition is generated by a change occurring with an exterior load that is applied to a generator; for example, when such exterior load is quickly and substantially reduced or eliminated. Similarly, any sudden load change would require utilization of overstroke protection to circuitry 84.

More particularly, overstroke protection circuitry 84 comprises a six-node voltage divider 86 coupled with a Zener diode 88 and an array of operational amplifiers 90 set up as comparators. A bank of six resistors 54 is provided in conjunction with six associated field effect transistors (FETs) 92, each comprising a switching device.

Zener diode $Z_1$ 88 is sized such that the maximum amplitude for power piston displacement is realized when running such generator at its highest operating amplitude. Similarly, battery charging circuitry 68 is tuned in at full power conditions for generator 10 (see FIG. 2). In order to set $Z_1$, a useful load or battery is disconnected from control circuitry 40 of FIG. 2, then a fully depleted battery bank is connected to control circuitry 40 where it is charged via battery charging circuitry 68. Generator 10 is then operated at full power, and control circuitry 40 is adjusted until there is no power going to bank of resistors 54. Such adjustment is carried out until voltage divider 86 begins to kick in resistor $R_1$, and such adjustment is then backed off until resistor $R_1$ just goes off. Hence, all power is going to the battery which is being charged, which generates a load. As such battery gets more and more charged, the battery can no longer consume all the power being generated by generator 10. Accordingly, resistors 54 begin to turn on, which causes excess power to be dumped therethrough. Accordingly, overstroke is prevented from occurring to power piston 28 (of FIG. 2). One such occurrence is caused when the battery is nearly fully charged, which causes such bank of resistors 54 to kick in and load down generator 10.

Also shown on FIG. 3, operational amplifiers (op amps) 90 are set up as comparators. Furthermore, voltage divider 86 compares the voltage drop across resistors $R_2$, $R_3$, $R_4$, $R_5$, $R_8$ and $R_{52}$. As current increases and a voltage drop occurs across each portion of divider 86, the voltage values exceed the respective values of $V_{REF}$, and a comparator output goes high, turning on each respective FET 92 and respective one of resistors 54. Such voltage divider comprises a ladder circuit that incrementally turns on resistors $R_1$, $R_{41}$, $R_{42}$, $R_{43}$, $R_{44}$ and $R_{45}$. The turning on of each successive one of resistors 54 by one of FETs 92 causes an incremental increase in loading which is placed upon generator 10. Such loading enhances the ability to prevent overstroke and to dissipate extra energy being produced by such generator. Accordingly, the voltage drop which occurs across the entire resistor network is generated by increases in current which occur through each next resistor such that the voltage drop increases sufficiently to kick in the next operational amplifier 90.

According to one implementation, resistors $R_2$ through $R_8$=8 Ω; resistor $R_{52}$=1KΩ; $R_{53\text{-}58}$=33KΩ; $R_{46\text{-}51}$=1KΩ; $R_{1,41,42,43,44}$ and $_{45}$=150 Ω; and $C_{28}$=0.1 microFarad (μF).

As shown in FIG. 3, $V_{REF}$ provides an input to op amps 90. Each op amp 90 forms a comparator that compares such reference voltage with a voltage drop that occurs across the associated ones of resistors $R_2$–$R_8$ and $R_{52}$. When such value for $V_{REF}$ is exceeded, output from comparator 90 goes high, turning on one of FETs 92 and the associated resistor 54. FIG. 3 also illustrates an input filter 94 configured to clean up power supply for op amps 90.

FIG. 4 illustrates voltage regulating circuitry 96 that generates the power supply voltage for op amps 90 (of FIG. 3). Such voltage regulating circuitry 96 decreases voltage from 110 volts down to 18 volts, in two stages. More particularly, a first stage voltage reduction is implemented by resistors $R_{60}$ and $R_{50}$, Zener diode $Z_3$, and $Q_{10}$. A second voltage reduction is provided by the remaining circuitry; namely, an off-the-shelf voltage regulator 98 shown as $U_7$, diode $D_5$, capacitors $C_2$ and $C_4$, and resistors $R_7$, $R_8$. Such first stage voltage reduction drops 110 volts down to 50 volts. Such second stage voltage reduction drops 50 volts down to 18 volts (18V). Resistor $R_9$ and Zener diode $Z_2$ generate reference voltage $V_{REF}$.

Figure 5:
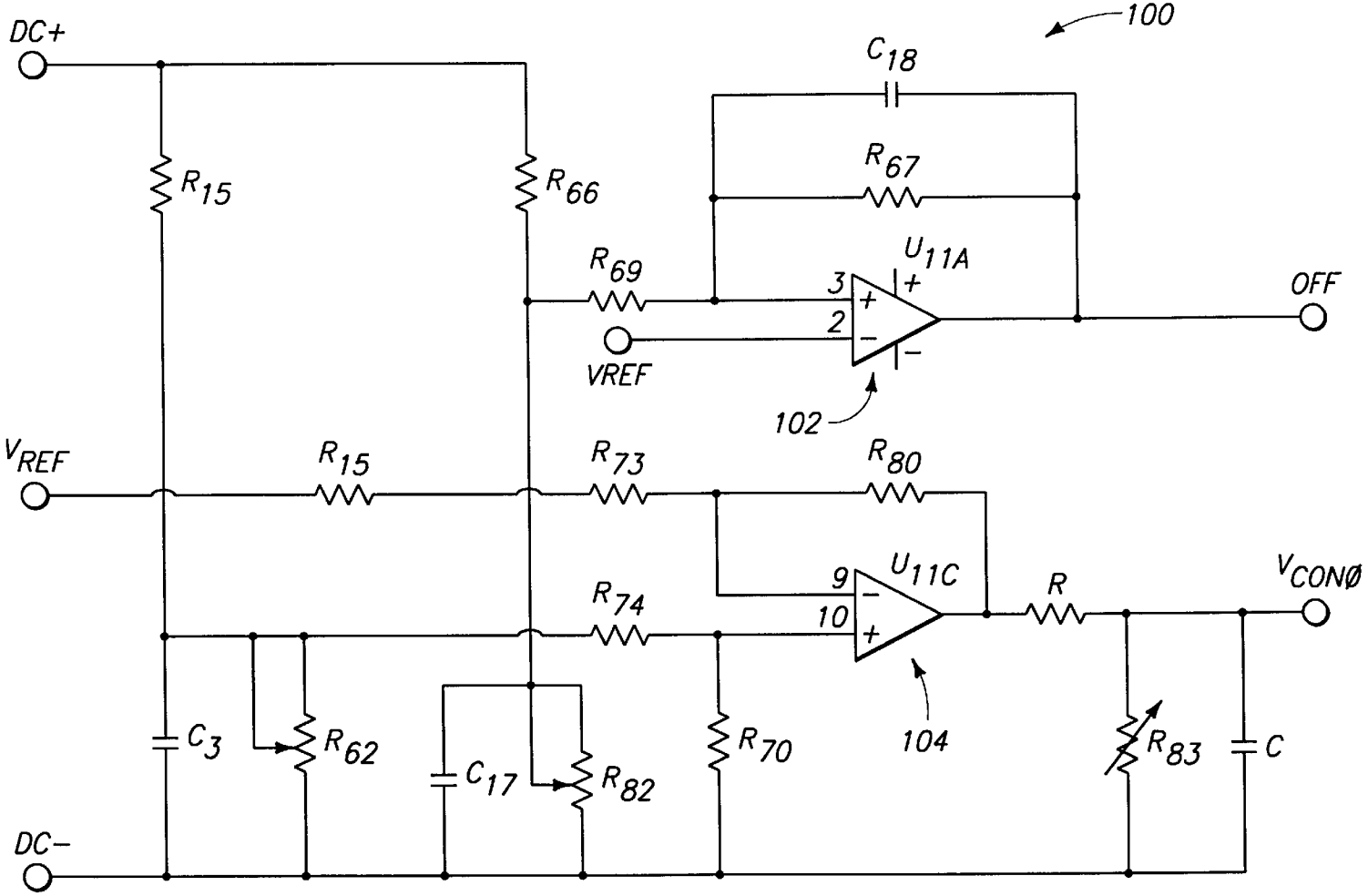
FIG. 5 is a simplified schematic circuit diagram for the control signal circuit of the moving member control system.

FIG. 5 illustrates a control signal circuit 100 operative to generate a control signal for battery charging circuitry 68 (of FIG. 2). More particularly, a control signal $V_{CON\ 0}$ is generated by such control signal circuit 100. Control signal $V_{CON\ 0}$ provides a control signal for the battery charger, or charging circuitry, which tells the battery charger how much current can be drawn off the DC rail without stalling generator 10 (of FIG. 2). Resistor $R_{62}$ is tuned such that control signal $V_{CON\ 0}$ is realized such that a maximum level of power is delivered to a battery during a charging operation at a maximum power condition, but without producing overstroke or stalling of a power piston 28 (of FIG. 2). Essentially, adjustment of resistor $R_{62}$ enables the production of power output to the batteries without having to enable dumping circuitry (bank of resistors 54 of FIG. 3). In essence, full power is realized and resistor $R_{62}$ is adjusted until the dumping circuitry basically stops firing.

Output signal "OFF" generates an output signal that gives capability for connecting generator 10 and control system 40 (of FIG. 2) with a heater control system (not shown) that controls energy input from heat source 16 (see FIG. 1). Hence, signal "OFF" is used when running a heater control system. More specifically, a heat source can be shut off via signal "OFF", for example, when a battery is fully charged. Essentially, fuel is shut off when the battery is fully charged in order to save fuel.

Control signal circuit 100 includes a pair of operational amplifiers 102 and 104. According to one implementation, such operational amplifiers are Motorola MC332745 integrated circuits.

As shown in FIG. 5, resister $R_{83}$ provides gain control of the control circuit that generates signal $V_{CON\ 0}$.

According to the implementation depicted in FIG. 5, control signal $V_{CON\ 0}$ is delivered to battery charging circuitry 68 (of FIG. 2). Such signal enables tuning such that a maximum level of power is delivered to a bank of batteries 70 (of FIG. 2) at a full power operating condition for generator 10 (of FIGS. 1 and 2).

Figure 6:
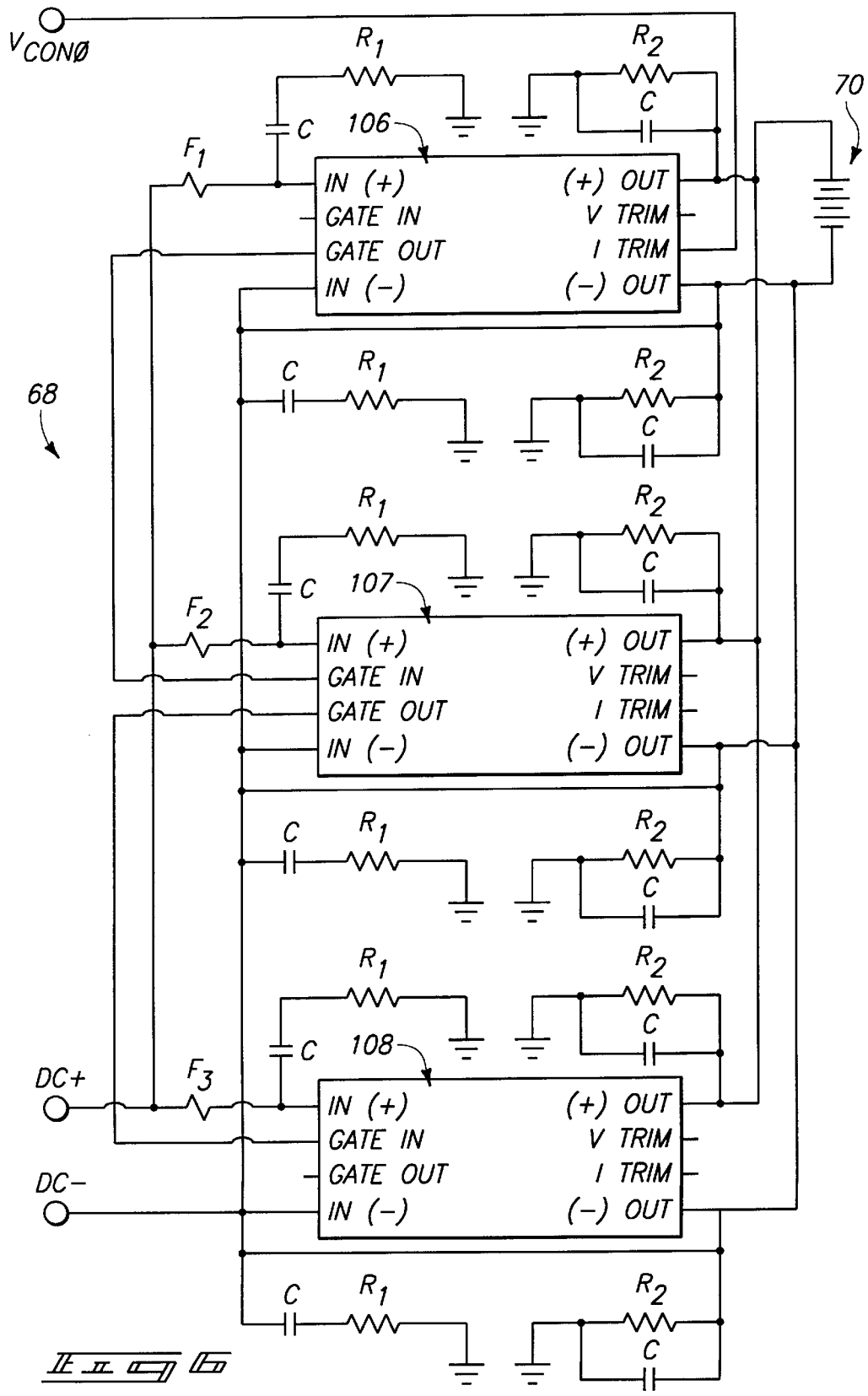
FIG. 6 is a simplified schematic circuit diagram for the battery charger unit of the moving member control system.
Figure 11:
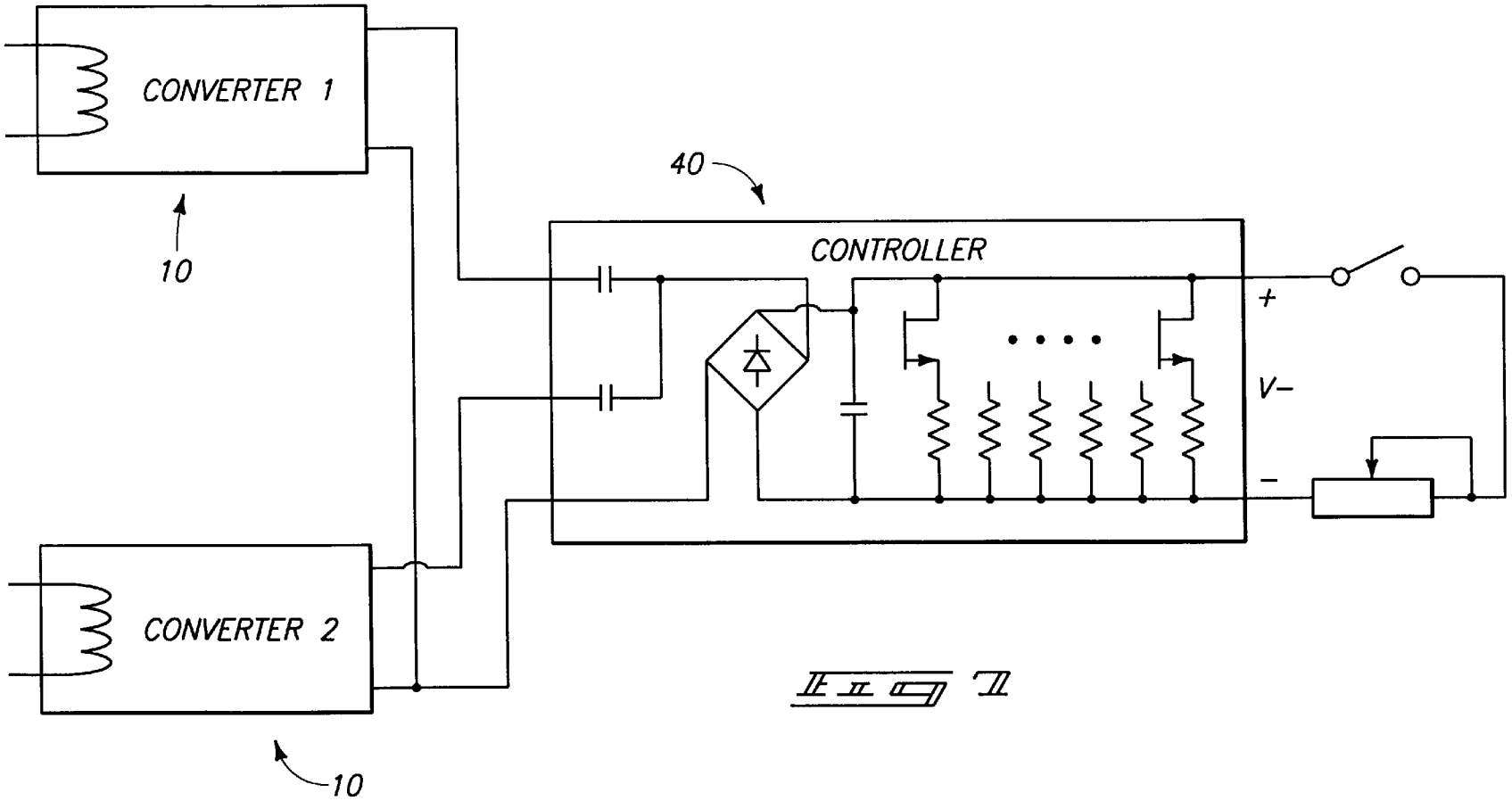

FIG. 6 illustrates battery charging circuitry 68 used in conjunction with battery 70. Battery charging circuitry 68 includes a plurality of DC/DC converters 106–108. Such converters 106–108 are each controllable such that an output is used to run a load; if the load becomes too great for the generator, such circuitry does not allow the battery charger 68 to pass any more power to the load (or battery). Such circuitry 68 enables a free-piston Stirling machine, such as an engine or generator, to provide a battery charging function for all potential battery conditions. At the same time, a linear alternator is protected by preventing an output piston from overstroking during a transient loading condition, or from potentially hazardous operating conditions. Such overstroke condition can occur when less power is drawn out than is produced by the generator. A stalling condition can lead to a transient loading condition which might overstroke a moving member, such as the power piston. Accordingly, a stalling condition can generate an overstroke condition which could damage a moving member.

FIG. 7 illustrates another preferred implementation of Applicant's invention wherein controller 40 as depicted with reference to FIGS. 1 and 2, and the implementation circuitry depicted in FIGS. 3–6, are used in combination with a pair of converters, or free-piston Stirling cycle generators 10. Such implementation is realized since each converter 10 is connected on the AC power side such that each converter 10 (converter #1 and converter #2) is able to phase lock with each other. If one of converters 10 begins to go out of phase, the other of converters 10 will pull the first converter back into phase. Additionally, converters 10 (converter #1 and converter #2) can be configured in assembly such that moving members are provided in opposed relation such that vibrations cancel out. For example, the moving piston within each converter can be configured in opposed relation with the other converter such that dynamic forces generated by respective moving members can substantially cancel out. Such configurations utilizes a single, common controller 40 which provides for synchronization and vibration cancellation.

Figure 8:
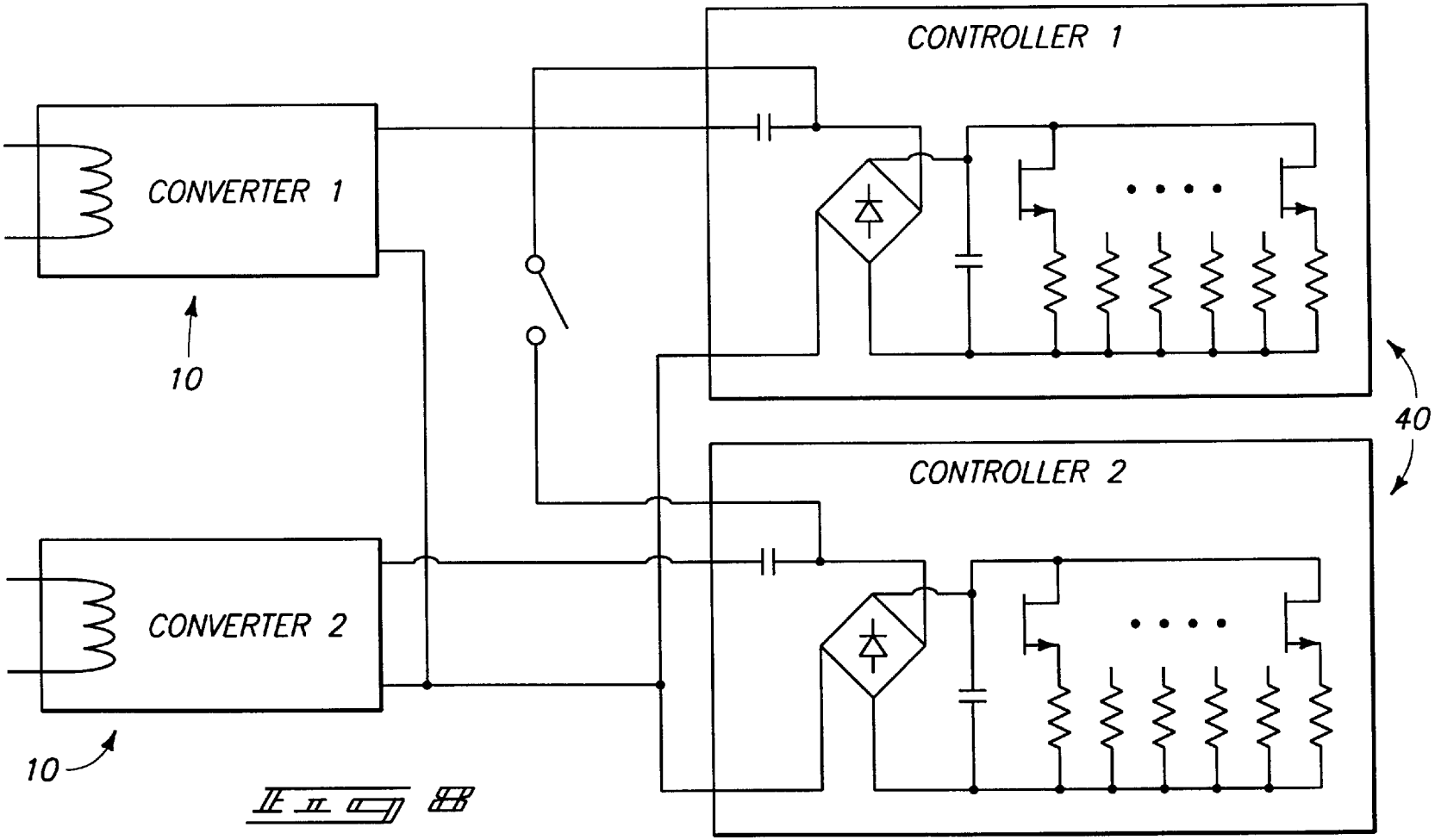
FIG. 8 is a simplified schematic block and circuit diagram for a multiple engine generator system using a pair of controllers.
Figure 11:
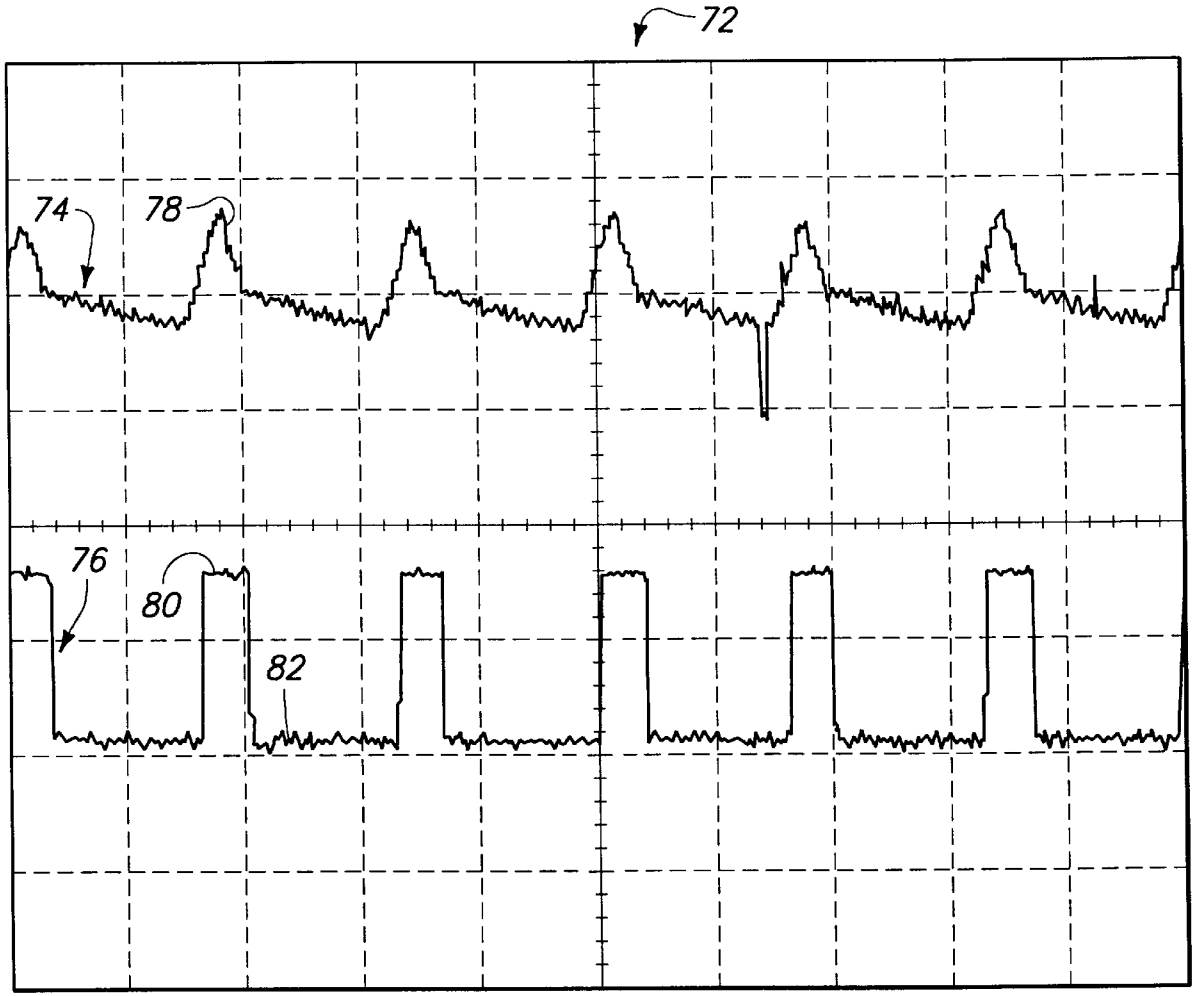

FIG. 8 illustrates yet another implementation of Applicant's invention wherein a pair of converters, or free-piston Stirling generators, 10 are coupled together, as well as controlled by a pair of controllers 40 (controller #1 and controller #2). Such implementation is similar to the implementation depicted in FIG. 7. However, redundancy is provided with the addition of an extra controller 40. In the event that one of controllers 40 fails, the other of controllers 40 can be used to run both of converters 10.

FIG. 9 illustrates an exemplary simplified oscilloscope display screen 72 generated by operation of generator 10 via control system 40 of FIGS. 1–6. More particularly, an exemplary DC output voltage 74 is depicted as generated by a voltage divider network along a DC rail. Secondly, a controllable load member enabling signal 76 is depicted corresponding in time with the exemplary DC output voltage 74. Ripple peaks 78 occurring on output voltage 74 are shown as triggering a controllable load member 46 (see FIGS. 1 and 2) switching on bank of resistors 54 (see FIGS. 2 and 3) when a ripple peak 78 is encountered. The switching on of a bank of resistors is indicated as "ON" by reference numeral 80, whereas such bank is indicated as being switched "OFF" by reference numeral 82.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A Stirling cycle machine control system, comprising:

an energy converter having a moving member;

a detector operatively associated with the moving member and configured to detect stroke of the moving member;

a converter circuit coupled with an output of the energy converter and operative to convert the output from AC to DC;

a regulator coupled with the converter circuit and a useful load and operative to regulate DC voltage;

a controllably variable load member coupled to the converter circuit and operative to adjust load to the energy converter so as to regulate power output of the energy converter which in turn controls movement of the moving member; and control circuitry signal coupled with the detector and the load member, configured to receive a feedback signal correlated with the detected stroke of the moving member, and operative to adjust load on the energy converter to limit stroke of the moving member below a threshold level.

2. The system of claim 1 wherein the energy converter comprises a Stirling cycle engine and a linear alternator, and the moving member comprises a power piston.

3. The system of claim 1 wherein the detector comprises a voltage detector.

4. The system of claim 1 wherein the detector comprises voltage detection circuitry.

5. The system of claim 1 wherein the load member comprises load circuitry.

6. The system of claim 5 wherein the load circuitry comprises a plurality of FETs and resistors, where the resistors are selectively energized so as to load down the energy converter and prevent overstroke of the moving member.

7. The system of claim 1 wherein the output regulator comprises a battery charger.

8. The system of claim 1 wherein the load member comprises a bank of resistors switchably coupled with output of the energy converter.

9. The system of claim 1 wherein the control circuitry comprises a Zener diode and voltage divider circuitry, an output voltage of the energy converter being compared with a reference voltage via the Zener diode and the voltage divider circuitry by the control circuitry.

10. The system of claim 1 wherein the regulator comprises regulating circuitry.

11. The system of claim 1 wherein the energy converter comprises a first free-piston Stirling cycle generator, and further comprising a second free-piston Stirling cycle generator having a moving member, the first and second free-piston Stirling cycle generators each operatively associated with the detector, the converter circuit, the regulator, the controllable load member and the control circuitry.

12. The system of claim 11 wherein the first free-piston Stirling cycle generator and the second free-piston Stirling cycle generator are configured in opposed relation such that each respective moving member is moving in opposite, mirror image relation such that the control circuitry synchronizes operation between the first and second free-piston Stirling cycle generators such that the respective moving members generate inertial forces that substantially cancel out.

13. A free-piston Stirling cycle generator control system, comprising:

a generator having a linear alternator and a power piston operative to receive energy from a source and generate an AC output;

an output voltage detector operatively associated with the power piston and configured to detect a threshold voltage value corresponding to displacement amplitude of the power piston;

a converter coupled with an output of the linear alternator and operative to convert the AC output to a DC output;

a regulator coupled with the converter and a useful load and operative to regulate DC voltage;

a load member coupled to the converter and operative to adjust load on the linear alternator such that power output is regulated from the linear alternator which in turn controls movement of the moving member; and control circuitry coupled with the detector and the load member, and configured to receive a feedback signal indicative of stroke of the moving member, and operative to adjust load on the linear alternator so as to limit stroke of the moving member within a threshold value.

14. The control system of claim 13 wherein the load member comprises a selectively engagable bank of resistors.

15. The control system of claim 13 wherein the load member comprises a battery, and further comprising battery charging circuitry, the battery coupled with the control circuitry via the battery charging circuitry.

16. The control system of claim 13 wherein the threshold value corresponds with a maximum acceptable stroke of the power piston.

17. The control system of claim 13 wherein the regulator comprises battery charging circuitry, the useful load comprises a battery, and wherein the threshold value corresponds to a stall condition of the generator caused by drawing too much current from the linear alternator.

18. A method for controlling a power piston within a free-piston Stirling cycle generator, comprising:

driving the generator by an external energy source so as to impart movement of a power piston of a linear alternator to generate an output voltage at an output;

correlating the output voltage with movement of the power piston;

detecting movement of the power piston by monitoring the the output voltage; and applying a load to the output voltage to adjust load on the linear alternator so as to limit movement of the power piston within a threshold value.

19. A method in accordance with claim 18 wherein a bank of resistors is controllably coupled with the output.

20. A method in accordance with claim 18 wherein battery charging circuitry and a battery are controllably coupled with the output.

21. The method in accordance with claim 18 wherein the step of applying a load comprises delivering a load to the linear alternator via a converter circuit.

22. A free-piston machine control system, comprising:

an energy converter having a moving member and an output;

a detector operatively associated with the moving member and configured to detect stroke of the moving member;

a controllably variable load member coupled to the output of the energy converter and operative to adjust load on the energy converter so as to regulate power output of the energy converter which in turn controls movement of the moving member; and control circuitry signal coupled with the detector and the load member, configured to receive a feedback signal correlated with the detected stroke of the moving member, and operative to adjust load imparted by the controllably movable load member on the energy converter to limit stroke of the moving member below a threshold level.

23. The system of claim 22 wherein the detector comprises a voltage detector and the controllably variable load member comprises load circuitry.

24. The system of claim 23 wherein the load circuitry comprises a plurality of FETs and resistors, and wherein the resistors are selectively energized to load down the energy converter and prevent overstroke of the moving member.

25. The system of claim 22 further comprising a converter circuit communicating with the output of the energy converter and operative to convert the output from AC to DC, and a regulator coupled with the converter circuit and a useful load and operative to regulate DC voltage.

* * * * *

UNITED STATES PATENT AND TRADEMARK OFFICE

CERTIFICATE OF CORRECTION

PATENT NO. : 6,050,092

DATED : April 18, 2000

INVENTOR(S) : Curtis Genstler, et al.

It is certified that errors appear in the above-identified patent and that said Letters Patent are hereby corrected as shown below:

Column 3, lines 52-53, delete "An array of annular shaped magnets are", and insert --An array of annular shaped magnets is--.

Column 3, lines 56-57, delete "an array of moving iron laminations that are", and insert --an array of moving iron laminations that is--.

Column 4, line 43, delete "R8" and insert --$R_8$--.

Column 9, line 37, delete "configurations utilizes", and insert --configuration utilizes--.

Column 12, line 2, delete "the the output", and insert --the output--.

Signed and Sealed this

Third Day of April, 2001

*Attest:*

NICHOLAS P. GODICI

*Attesting Officer*

*Acting Director of the United States Patent and Trademark Office*